United States Patent [19]

Pickard et al.

[11] 4,397,621

[45] Aug. 9, 1983

[54] VANE OF A VANE PUMP FOR HYDRAULIC OPERATING MEDIUM

[75] Inventors: Jürgen Pickard, Wernau; Jürgen Frank, Ebersbach, both of Fed. Rep. of Germany

[73] Assignee: Daimler-Benz Aktiengesellschaft, Fed. Rep. of Germany

[21] Appl. No.: 301,945

[22] Filed: Sep. 14, 1981

[30] Foreign Application Priority Data

Sep. 12, 1980 [DE] Fed. Rep. of Germany ..... 3034411

[51] Int. Cl.[3] ..... F01C 1/00; F03C 2/00

[52] U.S. Cl. ..... 418/236; 418/259

[58] Field of Search ..... 418/236, 238, 259, 266, 418/268

[56] References Cited

U.S. PATENT DOCUMENTS 2,949,081 8/1960 Deschamps ..... 418/135

FOREIGN PATENT DOCUMENTS 2145304 9/1971 Fed. Rep. of Germany ..... 418/268

*Primary Examiner*—Leonard E. Smith
*Assistant Examiner*—Jane E. Obee
*Attorney, Agent, or Firm*—Craig & Burns

[57] ABSTRACT

A vane for a hydraulic vane pump, with the vane being adapted to be inserted, with sliding movement, into a guide slot provided in a rotor so as to be symmetrical and parallel to a central plane of the slot. The plane forms a setting angle at an outer jacket of the rotor together with an axial plane containing the rotor axis so that an opening of the slot located at the outer jacket of the rotor leads the bottom of the slot in a direction of rotation. A convex sliding sealing surface cooperates with inner jacket of the stator and a pressure surface is located in the plane directed toward a bottom of the slot. A crown of the sliding sealing surface is displaced, with respect to the principle plane of the vane, in a direction opposite the rotational direction of the rotor. The sliding sealing surface forms, in a direction of rotation of the rotor, a wedge-shaped transistional area located at a plane which forms a complimentary angle combined with an addendum angle to the principle plane of the vane. The pressure surface forms, with the principle plane of the vane, a complimentary angle and, when combined with a re-setting angle, forms a 90° angle. The angle formed by the pressure surface is such that a pressure which results at the pressure surface includes a balancing pressure component which is directed approximately at right angles to the principle plane of the vane and approximately in a direction opposite to the rotational direction of the rotor.

17 Claims, 3 Drawing Figures

FIG. 1
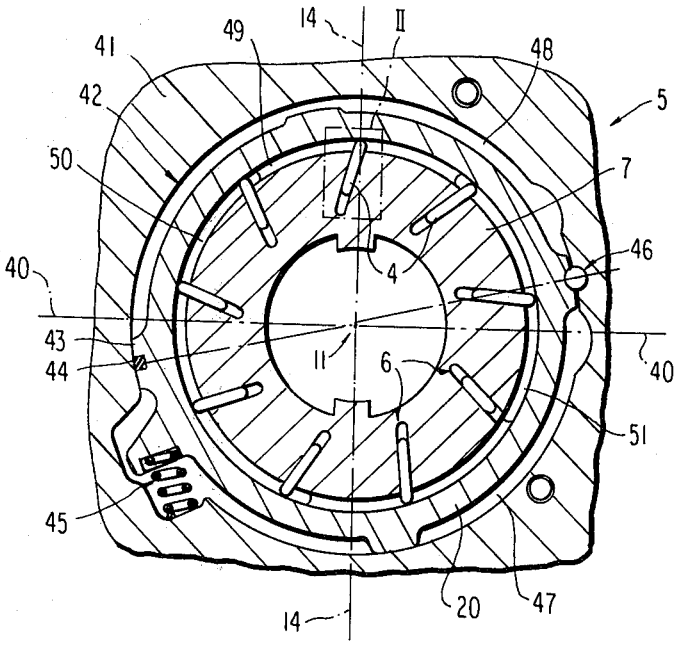
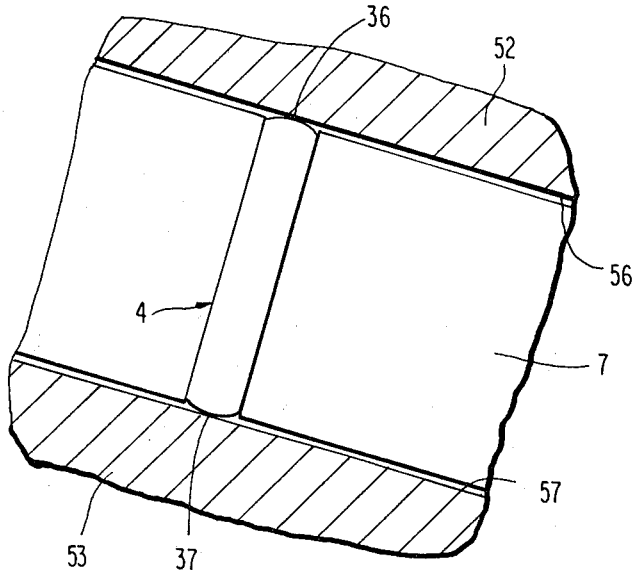
FIG. 3

VANE OF A VANE PUMP FOR HYDRAULIC OPERATING MEDIUM

The present invention relates to a vane and, more particularly, to a vane of a vane pump for a hydraulic operating medium, with the vane being insertable, by sliding movement, into a guide slot in a rotor, and with the walls of the slot supporting the vane circumferentially essentially non-movable relative to the rotor, symmetrically and parallel to a central plane of the slot, which plane extends parallel to the rotor axis and forms a setting angle at an outer jacket of the rotor together with an axial plane containing the rotor axis, so that the slot opening located at an outer jacket of the rotor leads the bottom of the slot in a rotational direction, and with the vane further being provided both with a convex sliding sealing surface cooperating with the inner jacket of a stator and with a pressure surface located in a plane and directed toward a bottom of a slot when installed.

With a vane of the aforementioned construction, tilting forces resulting from a hydraulic pressure and directed roughly at right angles to a central plane of the slot and associated frictional forces are advantageously smaller than in vane disposed radially with respect to an axis of the rotor. A vane of the aforementioned type is proposed in, for example, Offenlegungsschrift No. 29 22 951 wherein a sliding sealing surface is symmetrically rounded with respect to a central plane of the slot accommodating the vane thereby resulting in high friction forces between the vane and stator. A disadvantage of this arrangement resides in the fact that it is undersirable since the attitude of the vane already produces a pressure directed against the inner jacket of the stator which is a component of the tilting force which ensures that the sliding sealing surface fits flush against the inner jacket of the stator. Moreover, a further disadvantage resides in the fact that a pressure surface lies in a plane which is perpendicular to a center plane of the slot so that the pressure cannot influence the tilting forces.

In Offenlegungsschrift No. 24 05 575 a vane of a different type is proposed having a radial arrangement relative to an axis of the rotor, with a pressure surface lying in a plane which is inclined with respect to a central plane of the slot such that the pressure produces a non-balanceable residual force which is directed both perpendicularly with respect to a central plane of the slot accommodating the vane and in the direction of rotation. The residual force increases the tilting force which attempts to tilt the vane in the guide slot. This measure is intended to stabilize the vane in order to prevent it from shattering or other movements which are responsible for a developing of the squeaking.

The aim underlying the present invention essentially resides in providing a vane for a hydraulic operating vane pump which reduces the friction force which developed in the vane.

In accordance with advantageous features of the present invention, a crown of the sliding sealing surface is displaced in a direction opposite to a rotational direction relative to a principle plane of the vane which coincides with a central plane of the slot in the installed position. The sliding sealing surface makes a transition in a rotational direction to a wedge shaped area located in a plane which forms a complimentary angle to the principle plane of the vane, which adds up to 90° when combined with an addendum angle. The pressure surface forms a complimentary angle with the principle plane of the vane, which adds up to 90° when combined with a re-setting angle such a manner that the pressure which results at the pressure surface comprises a balancing pressure component which is directed approximately at right angles to the principle plane of the vane and roughly in a direction opposite to the rotational direction of the vane.

By virtue of the vane constructed in accordance with the present invention, a lubricating wedge effect develops at the sliding sealing surface to reduce friction so that both the friction that results from the pressure and the friction which results from a tilting moment of the tilting force at the guide slot is reduced by the resetting angle.

In accordance with further features of the present invention, a displacement of the crown of the sliding sealing surface is approximately one-third of a thickness of the vane measured at right angles to the principle plane of the vane.

Advantageously, the addendum angle is in the range of approximately 5° to 10° and the pressure surface is disposed in parallel to an axis of the rotor when installed.

The reset angle of the construction of the present invention is in the range of approximately 15° to 30°, with lateral surfaces, located transversely with respect to the principle plane of the vane, being of convex configuration.

Advantageously, the setting angle in the construction of the present invention is in the range of approximately 10° to 15° and, preferably, the vane pump is constructed with variable eccentricity of the rotor axis relative to the stator axis.

Accordingly, it is an object of the present invention to provide a vane for a hydraulic vane pump which avoids, by simple means, shortcomings and disadvantages encountered in the prior art.

Another object of the present invention resides in providing a vane for a hydraulic vane pump which substantially reduces friction forces developing in the vane.

Yet another object of the present invention resides in providing a vane for a hydraulic vane pump which reduces the tilting moment of a tilting force acting on the vane.

A still further object of the present invention resides in providing a vane for a hydraulic vane pump which is simple in construction and therefore relatively inexpensive to manufacture.

These and other objects, features, and advantages of the present invention will become more apparent from the following description when taken in connection with the accompanying drawing which shows, for the purpose of illustration only, one embodiment in accordance with the present invention, and wherein:

FIG. 1 is a partially schematic cross sectional view taken perpendicular to an axis of rotation of the vane pump and illustrating vanes constructed in accordance with the present invention;

FIG. 3 is a top view of a vane and rotor taken in direction of III in FIG. 2.

Figure 2:
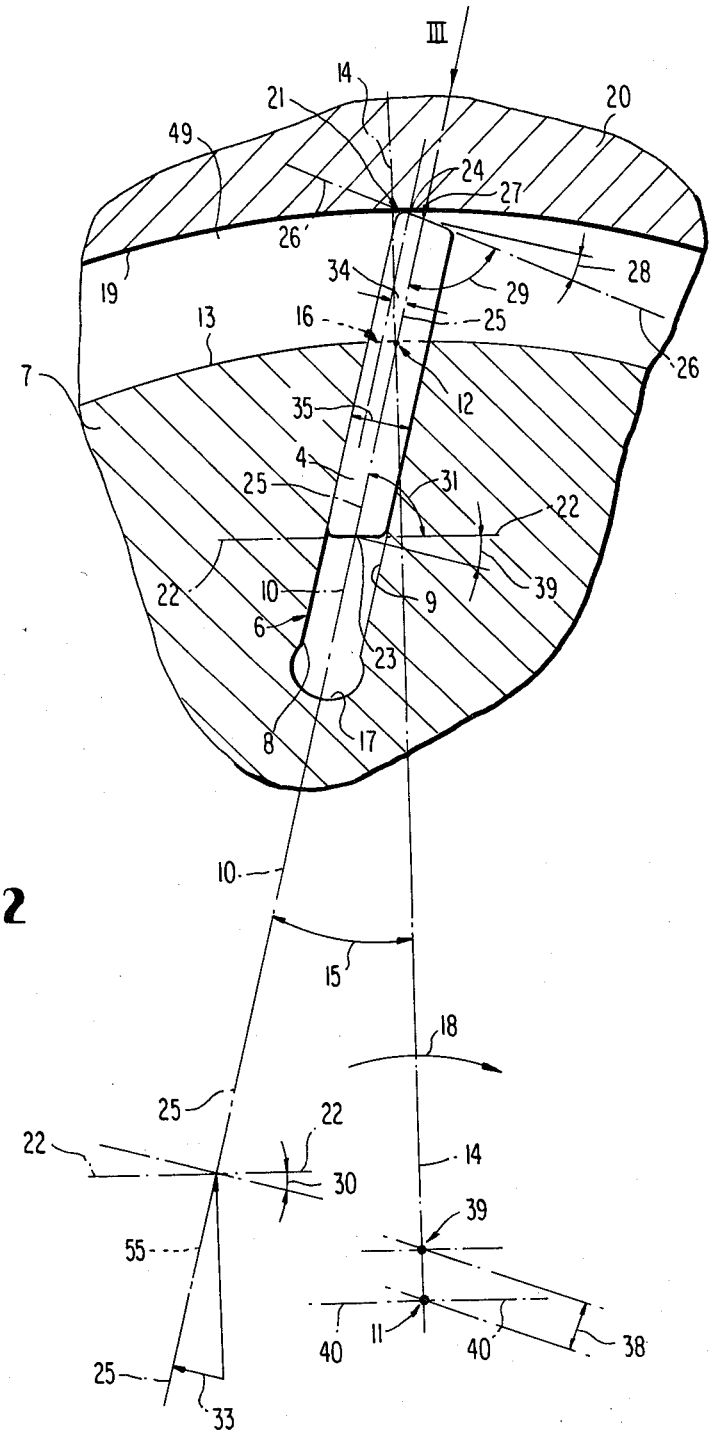
FIG. 2 is an enlarged detailed cross sectional view of the area designated II in FIG. 1 with a diagram of forces.

Referring now to the drawings wherein like reference numerals are used throughout the various views to designate like parts and, more particularly, to FIG. 1, which illustrates only features which are most important and required for an understanding of the invention, according to this figure, a hydraulic vane pump generally designated by the reference numeral 5 includes an annular housing part 41 with an essentially cylindrical recess generally designated by the reference numeral 42, an annular stator 20, and an annular rotor 7. The annular rotor 7 is provided with guide slots generally designated by the reference numeral 6. The guide slots are adapted to accept or accommodate vanes 4 in a manner so as to enable the vanes to slide within the guide slots 6. Two axial planes 14—14 and 40—40 of the housing part 41 are perpendicular both to one another and to the plane of the drawing, with the planes 14—14 and 40—40 intersecting in an axis generally designated by the reference numeral 11 of the rotor 7. A piston strip 42 runs parallel to the axial planes 14—14 and 40—40, with a vane seal 44 being provided on an outer circumference of the stator 20. The compression spring generally designated by the reference numeral 45 abuts the housing part 41 and is applied approximately tangentially to the stator 20. A pivot bearing generally designated by the reference numeral 46 permits the stator 20 to swivel or pivot with respect to the housing part 41 about a pivot axis which is both parallel to the axis 11 of the rotor 7 and is also fixed position wise.

The annular space of the recess 42 remaining between the stator 20 and housing part 41 is subdivided by sealing points at the bearing 46 and vane strip 43 into two semiannular working pressure chambers 47, 48, in which a hydraulic working pressure medium may be adjusted by means of a regulating valve (not shown) in order to determine or fix the throughflow of the vane pump 5 per unit of time, to permit stator 20 to swivel about the pivot bearing 46 in conjunction with the compression spring 45. As a result, as shown most clearly in FIG. 2, an eccentricity 38 of an axis, not shown of the stator 20 changes relative to the axis 11 of the rotor 7, fixed in space, and thus changes the throughflow of the vane pump 5 in a known manner.

As shown in FIG. 1, a suction connection 50 and a pressure connection 51 terminate in the annular space 49 formed between the rotors 7 and the stator 20, with the connectors 50, 51 being formed, in a manner not shown in detail in the drawings by axial recesses in side walls 52, 53 (FIG. 3) of the housing part 41, and communicating with pressure medium channels leading to the regulating valve.

As shown most clearly in FIG. 2, the slot 6 is defined by slot walls 8, 9. The slot walls 8, 9 support the vane 4 in the circumferential direction of the axis 11 of the rotor 7 so that the vane 4 is essentially immovable relative to the rotor 7. The vane 4 runs or extends symmetrically and parallel to a central plane 10—10 of the guide slots 6. The plane 10—10, extending parallel to the axis 11 of the rotor 7, and plane 14—14, containing the axis 11 of the rotor 7, intersect at a point 12 and outer jacket 13 of the rotor 7, with the planes 10—10 and 14—14 subtending or forming a setting angle 15 such that a slot opening generally designated by the reference numeral 16 of the guide slot 6, terminating in the annular chamber 49, leads a bottom 17 of the guide slot 6 in a direction of rotation 18 of the rotor 7. Advantageously, the setting angle 15 is in the range of approximately 10° to 15°.

As shown in FIG. 2, a principle plane 25—25 of the vane 4 coincides with the central plane 10—10 of the guide slot 6 when the vane 6 is installed. The vane 4 has a convex sliding sealing surface generally designated by the reference numeral 21 at a head end thereof which is located in the annular chamber 49. The convex sliding sealing surface 21 cooperates with the inside jacket 19 of the stator 20. A head of the sliding sealing surface 21 has a displacement 34 opposite to the direction of rotation 18 relative to the principle plane 25—25 of the vane 4. A magnitude of the displacement 34 is approximately one-third of a thickness 35 of the vane 4 as measured perpendicularly to the principle plane 25—25 of the vane. The sliding sealing surface forms a wedge-shaped area generally designated by the reference numeral 27 located in a plane 26—26 in the direction of rotation 18, with the surface 21 forming, together with the principle plane 25—25 of the vane 4, complementary angle 29 which adds up to 90° when combined with an addendum angle 28. The plane 26—26 lies parallel to the axis 11 of the rotor 7, whereby the addendum angle 28 is advantageous in the range of approximately 5° to 10° so that the lubricating wedge angle between the wedge-shaped area 27 and the inside jacket 19 of the stator 20 is approximately in the range of 15° to 25°.

At the end of the vane 4 facing the bottom 17 of the guide slot 6, a pressure surface 23 is located in a plane 22—22. The plane 22—22 lies parallel to the axis 11 of the rotor 7 and forms, with the principle plane 25—25 of the vane 4, a complementary angle 31 which adds up to 90° with a re-setting angle 30. Advantageously, the re-setting angle 30 lies in the range of approximately 15° to 30°. When the sliding sealing surface 21 is in sliding contact with inner jacket 19 of the stator 20, pressure surface 23 always exhibits a clearance relative to the bottom 17 of the guide slot 6 so that a pressure chamber 54 is formed in the guide slot 6. The pressure chamber 54 has a pressure medium connection (not shown) with the pressure connection 51. In this manner, when the vane pump 5 is operated as shown in FIG. 2, a pressure force 32 directed perpendicularly to the plane 22—22 is produced at the pressure surface 23. The pressure 32 has a pressure component 55 directed in or parallel to the principle plane 25—25 of the vane 4 and a balancing pressure component 33 directed perpendicularly with respect to the principle plane 25—25 of the vane 4. The balancing pressure component 33 reinforces the application of the sliding sealing surface 21 against the inside jacket 19 of the stator 20. The component 33 reduces the tilting moment which results from the fact that the tilting force appears at the vane 4 and the pressure which builds up in the direction of rotation 18 of the vane 4 in the annular chamber 19. The tilting force attempts to tilt the vane 4 around the tipping edge formed by the wall 8 of the guide slot 6 and outer jacket 13 of the rotor 7 further causing high friction forces which appear in the course of sliding movements of the vane 4 in the guide slot. The tilting force which appears at the vane 4 is perpendicular to the principle plane 25—25 of the vane 4 and is directed opposite to the direction of rotation 18.

In order to ensure a reduction of the tilting moment caused by the tilting force, the re-setting angle 30 must be arranged so that the plane 22—22 forms an acute angle, equal to complimentary angle 31, with a wall segment of the wall 8 of the guide slot 6 located rearwardly in the direction of rotation 18 leading to the opening 16 of the guide slot 6.

In order to maintain the friction between the vane 4 and ends 56, 57 of housing side walls 52, 53 which face one another, as shown most clearly in FIG. 3, corresponding lateral surfaces 36 and 37 of the vane 4 are made convex.

While we have shown and described only one embodiment in accordance with the present invention, it is understood that the same is not limited thereto but is suscceptible of numerous changes and modifications as known to one having ordinary skill in the art and we therefore do not wish to be limited to the details shown and described herein, but intended to cover all such modifications as are encompassed by the scope of the appended claims.

We claim:

1. A vane for a hydraulic vane pump including a rotor means, a stator means, slot means in the rotor means for slidingly accommodating the vane symmetrically in parallel to a central plane of the slot means, the vane including a convex sliding sealing surface cooperable with an inner jacket of the stator means, and a pressure surface facing a bottom end of the slot means, characterized in that the sliding sealing surface includes a crown, the crown is displaced with respect to a principle plane of the vane in a direction opposite to a direction of rotation of the rotor means, the sealing surface means forms, in a direction of rotation of the rotor means, a wedge-shaped area located in a first plane, the pressure surface is disposed in a second plane, the second plane forms with the principle plane of the vane an angle, a re-setting angle is formed between the plane in which the pressure surface is located and a line extending perpendicular to the principle plane of the vane, the angle and re-set angle form a 90° angle, the angle is such that a pressure at the pressure surface comprises a balancing pressure component directed approximately at right angles to the principle plane of the vane and in a direction opposite the rotational direction of the rotor means.

2. A vane according to claim 1, characterized in that the first plane forms with the principle plane of the vane a further angle, an addendum angle is formed between the plane in which the wedge-shaped area is located and a line extending perpendicularly to the principle plane of the vane, and in that the further angle and addendum angle form a 90°.

3. A vane according to claim 2, characterized in that the slot means includes spaced walls for circumferentially supporting the vane essentially non-movably relative to the rotor means, the principle plane of the vane coincides with the central plane of the slot means, and in that the central plane of the slot means extends parallel to a longitudinal center axis of the rotor means.

4. A vane according to claim 3, characterized in that the central plane intersects an axial plane passing through the axis of rotation of the rotor means at a point on an outer jacket of the rotor means, and in that a setting angle is formed between the central plane and axial plane so that an opening of the slot means at the outer jacket of the rotor means leads the bottom end of the slot means as viewed in a direction of rotation of the rotor means.

5. A vane according to one of claims 1, 2, 3, or 4, characterized in that the addendum angle is in the range of approximately 5° to 10°.

6. A vane according to one of claims 1, 2, 3, or 4, characterized in that the pressure surface extends in parallel to the axis of rotation of the rotor means.

7. A vane according to one of claims 1, 2, 3, or 4, characterized in that the re-set angle is in the range of approximately 15° to 30°.

8. A vane according to one of claims 1, 2, 3, or 4, characterized in that the vane is provided with lateral surfaces located transversely with respect to the principle plane of the vane, and in that the lateral surfaces are convex.

9. A vane according to one of claims 1, 2, 3, or 4, characterized in that means are provided for varying eccentricity of the axis of the rotor means relative to a longitudinal center axis of the stator means.

10. A vane according to claim 4, characterized in that the crown of the sliding sealing surface is displaced with respect to principle plane of the vane by a distance of approximately one-third of a thickness of the vane as measured at a right angle with respect to the principle plane of the vane.

11. A vane according to claim 10, characterized in that the addendum angle is in the range of approximately 5° to 10°.

12. A vane according to claims 4, 10, or 11, characterized in that the setting angle is in the range of approximately 10° to 15°.

13. A vane according to one of claims 4, 10, or 11, characterized in that the pressure surface extends in parallel to the axis of rotation of the rotor means.

14. A vane according to claim 13, characterized in that the re-set angle is in the range of approximately 15° to 30°.

15. A vane according to claim 14, characterized in that the vane is provided with lateral surfaces located transversely with respect to the principle plane of the vane, and in that the lateral surfaces are convex.

16. A vane according to claim 15, characterized in that the setting angle is in the range of approximately 10° to 15°.

17. A vane according to claim 16, characterized in that means are provided for varying eccentricity of the axis of the rotor means relative to a longitudinal center axis of the stator means.

* * * * *